US005377375A

United States Patent [19]

Holman et al.

[11] Patent Number: 5,377,375

[45] Date of Patent: Jan. 3, 1995

[54] STAIR CLEANING DEVICE

[75] Inventors: Andrew Holman, Poole; Graham Fairbrass, Christchurch, both of England

[73] Assignee: BTR plc, London, England

[21] Appl. No.: 194,502

[22] Filed: Feb. 9, 1994

[30] Foreign Application Priority Data

Feb. 10, 1993 [GB] United Kingdom ..... 9393557

[51] Int. Cl.[6] ..... A47L 11/16; A47L 11/40

[52] U.S. Cl. ..... 15/49.1; 451/353

[58] Field of Search ..... 15/49.1, 50.1, 98, 385, 15/87; 51/177

[56] References Cited

U.S. PATENT DOCUMENTS

| | | | |
|---|---|---|---|
| 2,941,222 | 6/1960 | Allen et al. | 15/49.1 |
| 3,169,262 | 2/1965 | Allen et al. | 15/49.1 |
| 4,150,456 | 4/1979 | Alvarez et al. | 15/49.1 |
| 4,862,548 | 9/1989 | Sergio | 15/49.1 |

FOREIGN PATENT DOCUMENTS

| | | |
|---|---|---|
| 677190 | 8/1952 | United Kingdom . |
| 823576 | 11/1959 | United Kingdom . |
| 921800 | 3/1963 | United Kingdom . |
| 1316903 | 5/1973 | United Kingdom . |
| 1417424 | 12/1975 | United Kingdom . |
| 1432524 | 4/1976 | United Kingdom . |
| 2158180A | 11/1985 | United Kingdom . |
| 2249022A | 4/1992 | United Kingdom . |

*Primary Examiner*—Edward L. Roberts
*Attorney, Agent, or Firm*—Nixon & Vanderhye

[57] ABSTRACT

A stair cleaning device intended for cleaning the steps and risers of stairs and other confined areas comprises three heads driven by a motor and a belt and pulley system. The belt is toothed on one side and not on the other side so that some slippage can occur. The advantages of this is improved operational comfort and less likelihood of damage to the drive system.

15 Claims, 3 Drawing Sheets

STAIR CLEANING DEVICE

This invention relates to a stair cleaning device for cleaning the steps and risers of stairs anti other confined areas, not necessarily on or near stairs.

In a known form of cleaning device, a plurality of horizontally disposed generally disc-shaped cleaning heads are mounted for rotation below a disc, the heads being driven by means of a drive mechanism such as a belt and pulley system positioned above the disc. The cleaning heads may be provided with e.g. bristles for scrubbing, wire bristles for scarifying, fabric pads for polishing or abrasive plates for abrading the surface to be cleaned.

Because stair cleaners are used to clean the steps and risers of stairs and/or other confined areas the likelihood of the cleaning head hitting an obstruction is more than that for a floor cleaner used to clean larger open areas. If a head is obstructed, even momentarily, damage may occur to the head and/or the drive mechanism.

It is an object of the present invention to reduce the possibility of such damage occurring.

In accordance with the invention a stair cleaning device comprises a plurality of cleaning heads arranged to rotate in a single plane, each head being mounted to rotate about an axis perpendicular to the said plane, a plurality of plain-surfaced pulleys, equal in number to the number of cleaning heads, each one of said pulleys being drivably connected to a respective cleaning head, a toothed driven pulley mounted with its axis of rotation parallel to the axes of rotation of the plain sided pulleys and a drive belt formed with teeth on one side thereof and being plain on the opposite side, the teeth of the belt engaging with the teeth of the driven pulley and the plain side of the belt frictionally engaged with the plain-surfaced pulleys thereby transmitting the drive to the cleaning heads.

Preferably three cleaning heads are provided and positioned at the corners of an imaginary equilaterial triangle.

Preferably the heads are mounted on one side of a disc and the belt and pulleys are mounted on the other side. The disc may be mounted to rotate and substantially fill the aperture of a generally dome-shaped or bowl-shaped housing which covers the belt and pulleys. A motor may be mounted on the housing driving a shaft which in turn drives the driven pulley. A handle for an operator may be connected by means of a pivot or any other means to the housing.

One embodiment of the invention, a stair cleaner which may be used to clean confined spaces in addition to the treads and risers of stairs will now be described by way of example only, with reference to the accompanying drawings of which:

Figure 1:
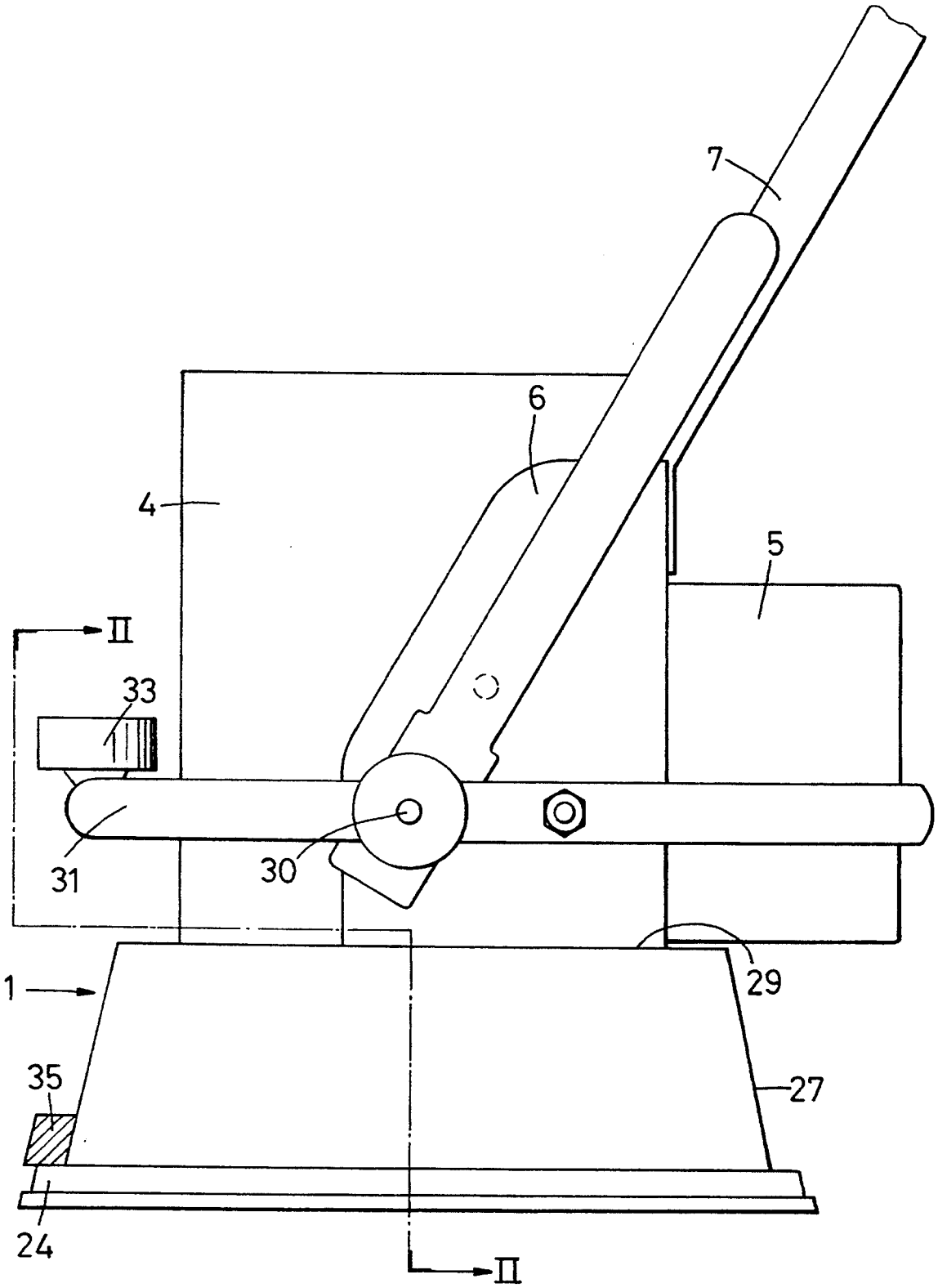
FIG. 1 shows a side; view of the lower part of the stair cleaner according to the invention.

As shown in the drawings the; stair cleaner of the present invention comprises a generally inverted bowl-shaped housing 1 having a flat top surface 29 and a generally part-conical side skirt 27, covering a drive mechanism 3 for a plurality of cleaning heads 2, a motor 4 mounted by means of a bracket 6 on the top surface 29 of the housing 1, a control system 5 for the motor 4, and a handle arrangement 7 by means of which a person may control the cleaner.

Figure 3:
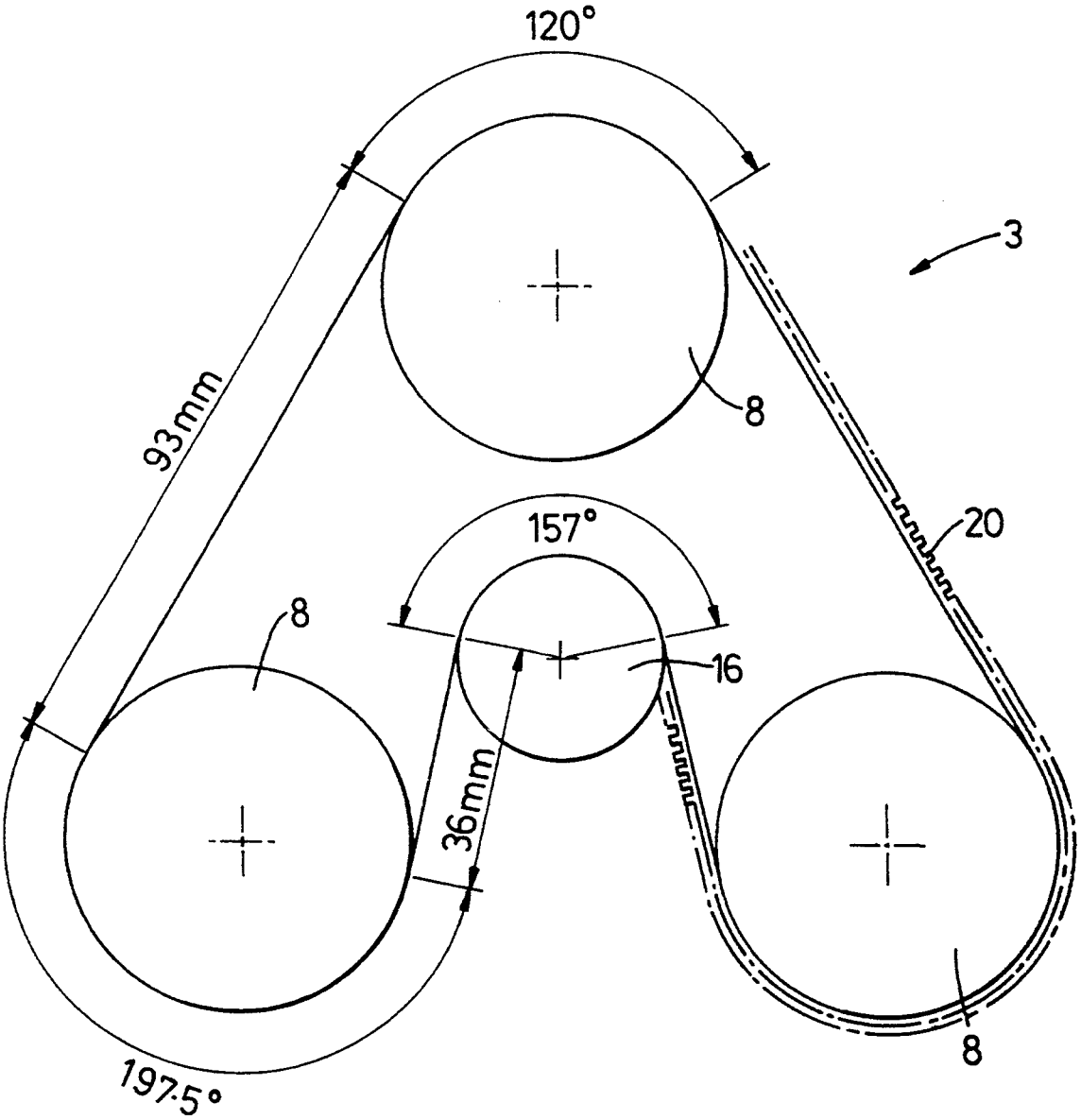
FIG. 3 shows a schematic layout of the belt and pulley system of the stair cleaner shown in FIG. 1.

Three disc-shaped cleaning heads 2 e.g. brushes are provided, each mounted on one side of a plain-surfaced pulley 8, the head and pulley being mounted on a vertically disposed spindle 9 by means of a bearing 10. The centers of rotation of the heads 2 and pulleys 9 are positioned at the corners of an equilaterial triangle as can be seen in FIG. 3. The three spindles 9 are mounted to project downwards from the lower surface of a member 11 which is freely rotatable about a bearing 12 mounted on a boss 13 secured centrally to the underside of the top 29 of the housing 1. The member 11 may be generally disc-shaped, in the form of a three-armed spider with each spindle 9 mounted at the end of an arm, or of any suitable shape. The motor 4 is preferably an electric motor with a nominal output power of up to about 500 watts operating usually at 1500 revolutions per minute, but possibly up to 3000 revolutions per minute. Projecting downwards through a vertical aperture 14 in the boss 13 from the motor 4 is a shaft 15 which drivably connects the motor to a toothed pulley 16 positioned at the same horizontal level as and between the three plain-surfaced pulleys 8. A bearing (not shown) may be provided in tile aperture 14 to support the shaft 15. A belt 20, being plain on one side and toothed on the other passes around the pulleys 8 and 16 as shown particularly in FIG. 3. The teeth of the central pulley 16 engage the toothed side of the belt 20 and the plain side of the belt engages the plain surfaces of the pulleys 8.

Mounted below the member 11 which supports the three vertical spindles 9 is a horizontally-disposed disc 21 which is connected to the member by means of three vertical posts 22. Each post is positioned on a similar pitch centre diameter as the spindles 9, one post being equally spaced from each one of an adjacent pair of spindles. Thus the disc 21 rotates with the disc-shaped member 11 on the bearing 12.

Figure 2:
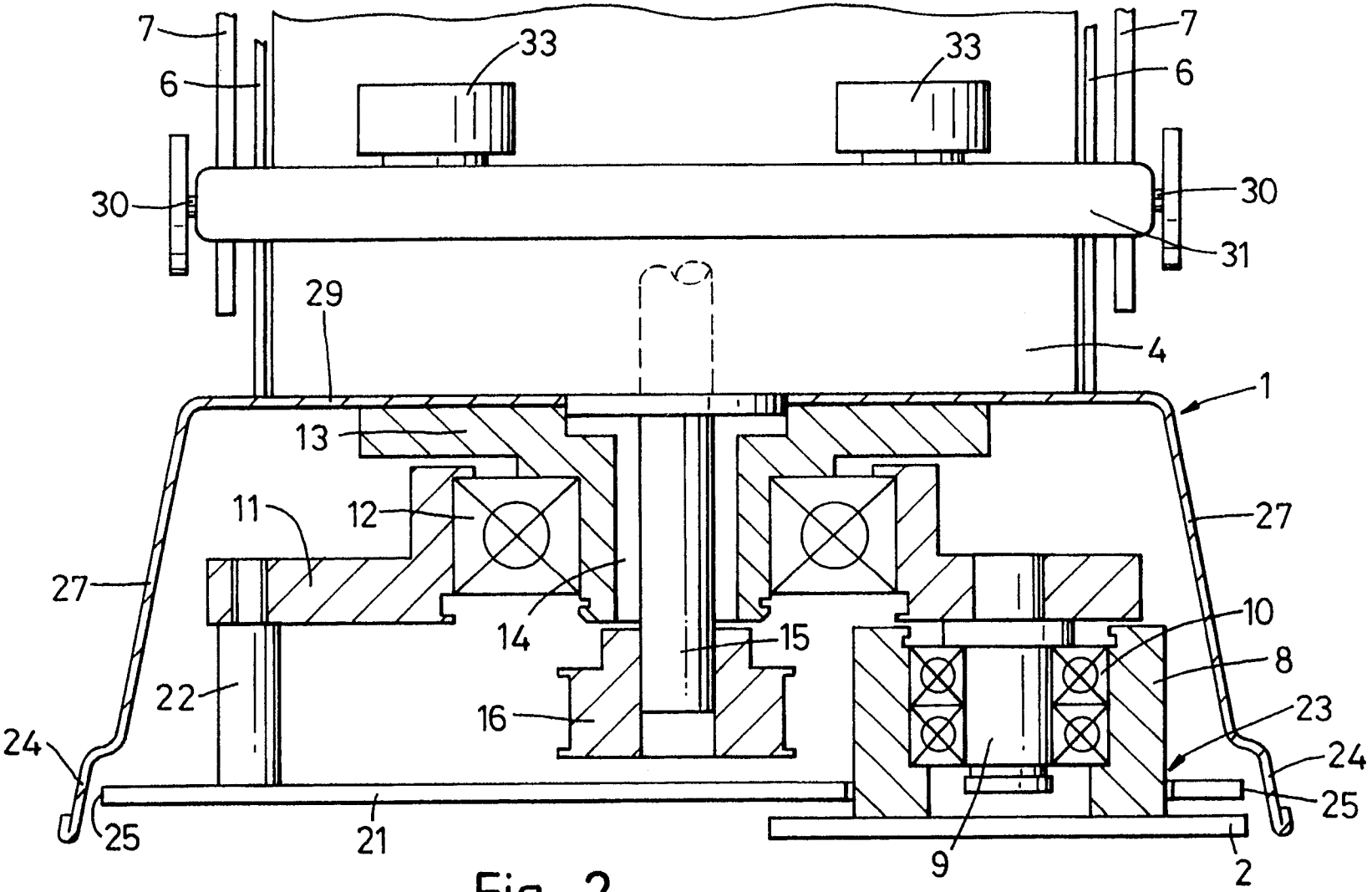
FIG. 2 shows a part-sectional part-front view on line 2—2 of FIG. 1.

As can be seen particularly in FIG. 2, the disc 21 is formed with three apertures 23, the lower part of a plain-surfaced pulley 8 projecting through a respective aperture 23. The cleaning heads 2 are thus positioned below the disc 21 whilst the belt and pulley system and other pans of the drive mechanism for the cleaning heads is located above the disc 21 and within the housing 1. The area swept by the cleaning heads 2 an rotation of the disc 21 is a circle having a diameter of about 200 mm. The diameter of the disc 21 is slightly less than the internal diameter of an enlarged part 24 of the housing 1 formed adjacent the bottom edge of the side skirt 27 and slightly greater than the diameter of the skirt immediately above the enlarged part. The disc 21 thus almost fills the lower opening of the housing and the closeness of the peripheral edge 25 to the enlarged part 24 of the skirt 27 substantially reduces the ingress of dirt etc. to the interior of the housing and the drive mechanism located therein and any subsequent damage by the dirt etc. to the drive mechanism is prevented.

As can be seen in FIG. 1 the handle 7 is pivotally connected at pivot points 30 to a horizontally-disposed rectangular bar 31 which is connected to the bracket 6 on the top 29 of the housing. The bar 31 is positioned to surround the motor 4 and the control box 5. One side 32 of the rectangularly shaped bar 31 supports the two freely rotatable rollers 33 which as can be seen in FIG. 1 are generally above a protective block 35 located on part of the skirt 27 of the housing 1 immediately above the enlarged lower part 24. This arrangement of rollers 33 and block 35 enables the cleaner to be used with the rollers 33 and block 35 on a horizontal surface e.g. a stair tread with the heads disposed so as to clean a vertical surface e.g. a stair riser. The bar 31 provides support and a degree of protection for the motor and control box and may be used as a handle by an operator.

In normal use the rotation of the heads against a surface e.g. a stairtread, causes a reaction torque. Since the heads are all supported in the member 11 which is freely rotatable about the boss 13 which is fixed to the housing, the whole assembly of the heads 2, plain-surfaced pulleys 8, belt 20, member 11, post 22 and disc 21 rotate in the opposite sense to the heads and thus prevent the reaction torque being transmitted to the housing and hence to the handle. The operator may therefore control the cleaner much more readily than if the assembly was not so freely rotatable.

As can be seen in FIG. 3, the plain-surfaced pulleys 8 are of larger diameter than the central driven toothed pulley 16. A typical construction for a swept circle having a diameter of 200 mm has the plain-surfaced pulleys of 50 mm diameter on 108 mm pitch centre diameter. The driven pulley has an outer diameter of 32 mm. This means that there is a 93 mm length of belt between two adjacent plain pulleys and a 36 mm plain run between a plain pulley and the toothed pulleys. The arc length of each pulley surface engaged by the belt is indicated in degrees in FIG. 3.

In a modification (not shown) the cleaner is not provided with a motor on the housing but instead is provided with a connection for a flexible drive shaft. Thus rotational drive power may be transmitted from a distant position to the shaft 15 e.g. to the end thereof projecting through tile housing.

By providing a belt which is toothed on one side and which engages with a toothed drive pulley, torque is much more effectively transmitted from the motor to the belt than if a plain-sided pulley and belt were used. However by providing a plain surface which frictionally engages the three plain-surfaced pulleys to which the heads are attached, if any head hits an obstruction and is momentarily braked by the obstruction, some slippage can occur, e.g. the belt can slip on that particular pulley without really affecting the drive to the other two pulleys and attached heads. The likelihood of damage to the belt and/or the motor is reduced. In addition the start reaction is reduced due to the initial slip of the belt when the motor is first switched on. This means that the cleaning device of the present invention is far safer and more comfortable to operate than previously-used single-disc devices.

We claim:

1. A stair cleaning device comprising a plurality of cleaning heads arranged to rotate; in a single plane, each head being mounted to rotate about an axis perpendicular to the said plane, a plurality of plain-surfaced pulleys, equal in number to the number of cleaning heads, each one of said pulleys being drivably connected to a respective cleaning head, a toothed driven pulley mounted with its axis of rotation parallel to the axes of rotation of the plain-sided pulleys and a drive belt formed with teeth on one side thereof and being plain on the opposite side, the teeth of the belt engaging with the teeth of the driven pulley and the plain side of the belt frictionally engaged with plain-surfaced pulleys thereby transmitting the drive to the cleaning heads.

2. A stair cleaning device according to claim 1 comprising three cleaning heads.

3. A stair cleaning device according to claim 2 wherein the three cleaning heads are positioned at the corners of an imaginary equilateral triangle.

4. A stair cleaning device according to claim 1 comprising a disc, tile heads being mounted on one side of the disc and the belt and pulleys being mounted on the other side of the disc.

5. A stair cleaning device according to claim 4 wherein the disc is mounted to rotate.

6. A stair cleaning device according to claim 4 wherein the disc is mounted to be freely rotatable about a central axis thereby substantially or completely offsetting the torque reaction from the cleaning heads in use.

7. A stair cleaning device according to claim 6 wherein the area swept by the cleaning heads on rotation of the disc is a circle having a diameter of about 200 mm.

8. A stair cleaning device according to claim 4 comprising a housing which covers the belt and pulleys, the housing having an aperture which is substantially filled by the disc.

9. A stair cleaning device according to claim 1 comprising a housing which covers the belt and pulleys.

10. A stair cleaning device according to claim 9 comprising a motor mounted on the housing to drive the driven pulley.

11. A stair cleaning device according to claim 10 wherein the motor is an electric: motor having an output power of about 500 W.

12. A stair cleaning device according to claim 11 wherein the motor operates at about 1500 revolutions per minute.

13. A stair cleansing device according to claim 11 wherein the motor operates at up to about 3000 revolutions per minute.

14. A stair cleaning device according to claim 9 comprising a handle connected to the housing.

15. A stair cleaning device according to claim 1 comprising a connection to a flexible drive shaft.

* * * * *

UNITED STATES PATENT AND TRADEMARK OFFICE

CERTIFICATE OF CORRECTION

PATENT NO. : 5,377,375

DATED : January 3, 1995

INVENTOR(S) : Holman et al.

It is certified that error appears in the above-indentified patent and that said Letters Patent is hereby corrected as shown below:

Column 1, line 5, change "anti" to --and--;
Column 1, line 62, delete ";";
Column 2, line 25, change "tile" to --the--;
Column 2, line 47, change "an" to --on--; and
Column 3, line 55, delete ";" after "rotate".

IN THE CLAIMS:

Column 3, line 55, delete ";";
Column 4, line 19, change "tile" to --the--; and
Column 4, line 43, delete":".

Signed and Sealed this

Fourteenth Day of March, 1995

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,377,375
DATED : January 3, 1995
INVENTOR(S) : HOLMAN et al.

It is certified that error appears in the above-identified patent and that said letters patent is hereby corrected as shown below:

On the title page, item "[30] Foreign Application Priority Data", change "9393557" to --9303557.4--.

Column 3, line 35, change "tile" to --the--.

Signed and Sealed this

Eighth Day of August, 1995

*Attest:*

Bruce Lehman

BRUCE LEHMAN

*Attesting Officer*

*Commissioner of Patents and Trademarks*